US005695316A

United States Patent [19]

Schütz et al.

[11] Patent Number: 5,695,316

[45] Date of Patent: Dec. 9, 1997

[54] FRICTION VACUUM PUMP WITH PUMP SECTIONS OF DIFFERENT DESIGNS

[75] Inventors: Günter Schütz, Köln; Heinrich Engländer, Linnich; Friedrich Karl von Schulz-Hausmann, Bonn; Hinrich Henning, Bergisch Gladbach, all of Germany

[73] Assignee: Leybold Aktiengesellschaft, Cologne, Germany

[21] Appl. No.: 545,646

[22] PCT Filed: Mar. 31, 1994

[86] PCT No.: PCT/EP94/01011

§ 371 Date: Oct. 30, 1995

§ 102(e) Date: Oct. 30, 1995

[87] PCT Pub. No.: WO94/25760

PCT Pub. Date: Nov. 10, 1994

[30] Foreign Application Priority Data

May 3, 1993 [DE] Germany ..... 43 14 418.7

[51] Int. Cl.[6] ..... F01D 1/36

[52] U.S. Cl. ..... 415/90; 415/143; 417/423.4

[58] Field of Search ..... 415/90, 143; 417/423.4

[56] References Cited

U.S. PATENT DOCUMENTS

| | | | |
|---|---|---|---|
| 1,975,568 | 10/1934 | Dubrovin . | |
| 3,969,039 | 7/1976 | Shoulders | 415/90 |
| 4,732,529 | 3/1988 | Narita . | |
| 5,219,269 | 6/1993 | Ikegami et al. | 415/90 |
| 5,358,373 | 10/1994 | Hablanian | 415/90 |

FOREIGN PATENT DOCUMENTS

| | | | |
|---|---|---|---|
| 0445855 | 9/1991 | European Pat. Off. . | |
| 2161179 | 7/1973 | France . | |
| 2280809 | 2/1976 | France . | |
| 2534980 | 4/1984 | France . | |
| 3442843 | 6/1985 | Germany . | |
| 3919529 | 1/1990 | Germany . | |
| 3922782 | 2/1990 | Germany . | |
| 60-116896 | 6/1985 | Japan | 415/90 |
| 60-125795 | 7/1985 | Japan | 415/90 |
| 61-226596 | 10/1986 | Japan | 415/90 |
| 63-85291 | 4/1988 | Japan | 415/90 |
| 1285198 | 1/1987 | U.S.S.R. | 417/423.4 |
| 2129068 | 5/1984 | United Kingdom | 417/423.4 |
| 2155103 | 9/1985 | United Kingdom . | |

OTHER PUBLICATIONS

Journal of Vacuum Science & Technology, vol. 8, No. 5, Sep. 1990, New York, US pp. 3870–3873, XP000147920 J. Y. Tu 'A new design for the disk-type molecular pump'.

*Primary Examiner*—Christopher Verdier
*Attorney, Agent, or Firm*—Harris Beach & Wilcox, LLP

[57] ABSTRACT

A friction vacuum pump (1) is provided with pump sections of different designs, of which the pump section on the inlet side consists of turbomolecular pump stages (14, 15) and a further pump section of Siegbahn stages (16, 17) with spiral grooves (19), whereby the active pumping surfaces of the Siegbahn stages are formed by facing surfaces of an annular rotor disc and an annular stator disc (16, 17). To simplify the production of such a pump, it is proposed that the annular stator discs (16) have spiral grooves (19).

31 Claims, 10 Drawing Sheets

FRICTION VACUUM PUMP WITH PUMP SECTIONS OF DIFFERENT DESIGNS

CROSS-REFERENCES TO RELATED APPLICATIONS

This application claims benefit under 35 U.S.C. §120 of PCT international application PCT/EP94/01011, filed on Mar. 31, 1994.

BACKGROUND OF THE INVENTION

The invention relates to a friction vacuum pump with pump sections of different designs, of which the pump section on the inlet side consists of turbomolecular pump stages and a further pump section of Siegbahn stages with spiral grooves, whereby the active pumping surfaces of the Siegbahn stages are formed by facing surfaces of an annular rotor disc and an annular stator disc.

The class of friction vacuum paps comprises Gaede mercury pumps (wherein a cylinder, having both a pump slot and a barrier slot arranged between the inlet and the outlet, rotates within a housing), Holweck pumps (wherein a cylinder having spiral grooves arranged on the stator or on the rotor rotates within a housing), Siegbahn pumps (rotating and stationary annular discs with spiral grooves), and turbomolecular pumps (equipped with rotating and guiding blades). It is known to equip friction pumps with differently designed pumping sections.

A friction pump of the aforementioned kind is known from DE-OS 39 22 782. In this known friction pump the rotor discs of the Siegbahn stage are equipped with the spiral grooves. Production of a friction pump of this kind is relatively involved, since not only its stator but the rotor too must be manufactured and assembled from a large number of individual parts.

It is the task of the present invention to simplify the production of a friction vacuum of the aforementioned kind.

SUMMARY OF THE INVENTION

According to the present invention this task is solved for a friction vacuum pump of the aforementioned kind by equipping the annular stator discs with the spiral grooves. Through this measure it is on the one hand no longer required to produce the rotor from numerous individual parts. The rotor can be formed from a single piece and may be cut from a single solid piece for example. Moreover, adaptation of a friction pump of the kind addressed here with regard to different applications is simplified because in vacuum pumps of the this kind the properties of the spiral grooves (depth, width, pitch) determine the pump's characteristics. When wanting to change the pump's characteristics in the case of a friction pump built according to the state of the art, stator and rotor will have to be disassembled after each other, the rotor discs with the spiral grooves will have to be exchanged and then rotor and stator will have to be fitted again. In a friction vacuum pump built according to the present invention only the stator will have to be disassembled and reassembled with exchanged discs.

A further advantage of the measure according to the present invention is that the pump section with the Siegbahn stages is followed by at least one further pump stage of any kind—preferably following a friction pump—which has in the intermediate range between molecular flow and viscous flow, good pumping characteristics. With a so designed vacuum pump it is possible to generate a relatively high backing pressure (over 10 mbar), so that pumps of this kind may be operated with small and cheap backing pumps.

BRIEF DESCRIPTION OF THE DRAWINGS

The above, and other objects, features and advantages of the present invention will become apparent from the following description read in conjunction with the accompanying drawings, in which like reference numerals designate the same elements.

Further advantages and details of the present invention shall be explained on the basis of the design examples of the drawing FIGS. 1 to 18.

DESCRIPTION OF THE INVENTION

Figure 1:
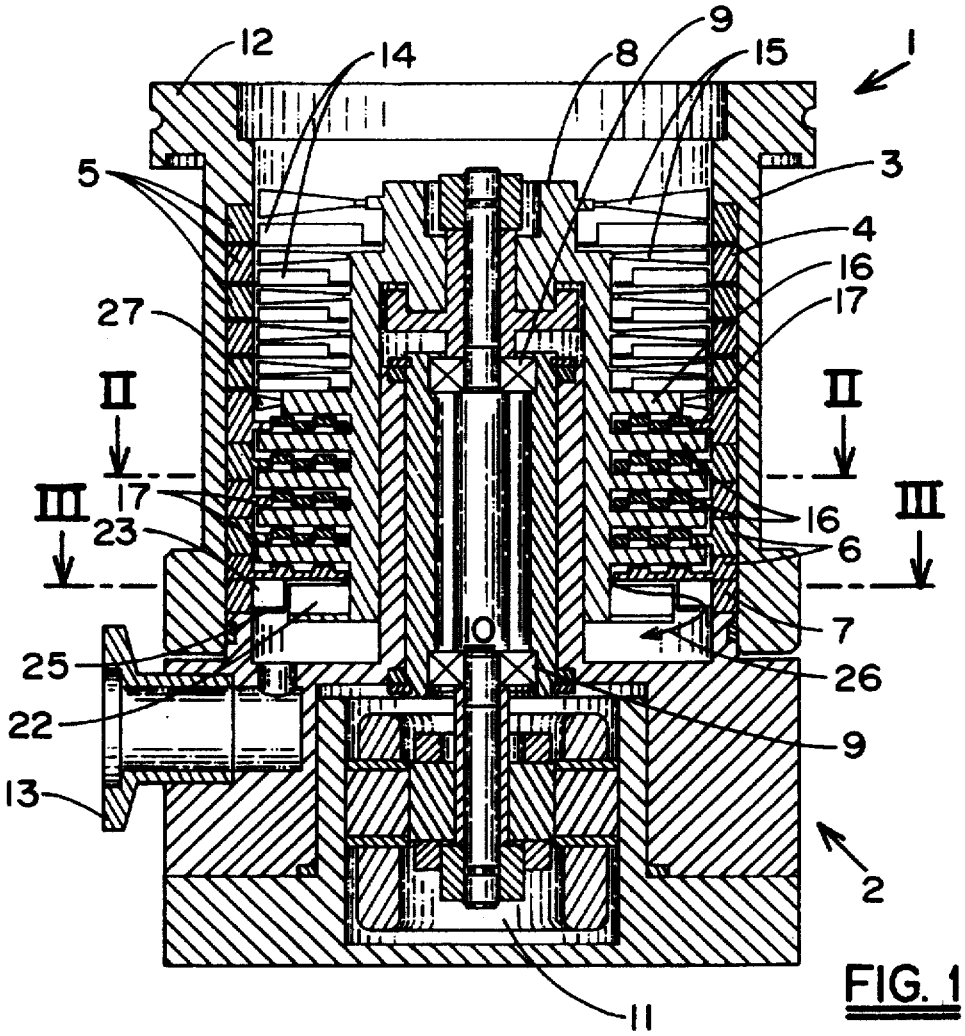
FIG. 1 shows a sectional view of a friction vacuum pump according to an embodiment of the present invention.

In the case of the design example according to drawing FIG. 1 a friction vacuum pump 1 is presented, the housing of which is marked as 2. The upper, cylindrically designed housing section 3 embraces and centers stator 4 which comprises several stator rings 5, 6 and 7. The rotor 8 is supported in the pump housing 2 via the bearings 9 and pump shaft 10. The drive motor is marked 11. During operation of the pump, a chamber which is to be evacuated is connected to inlet flange 12. Due to the rotation of rotor 8 the gases are pumped to outlet 13, to which a backing pump is connected.

Figure 2:
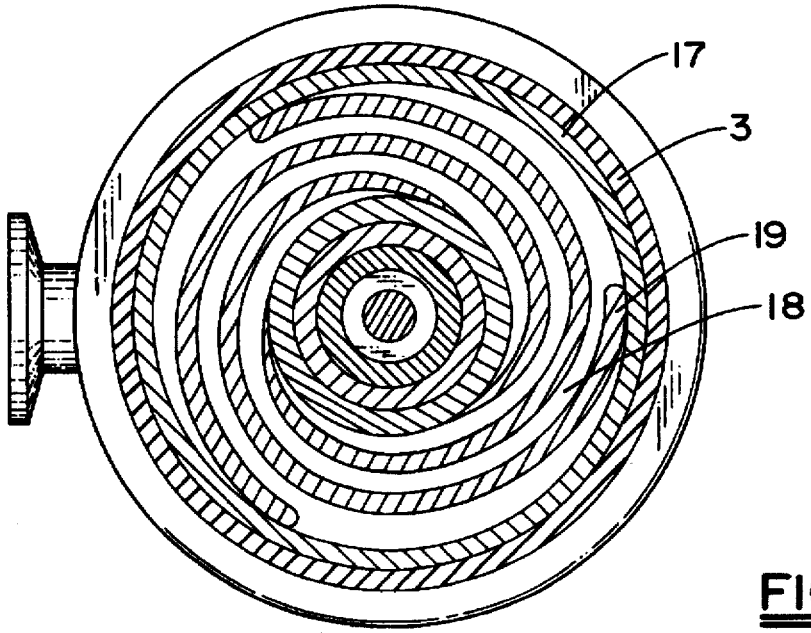
FIG. 2 shows a sectional view along line II—II through the pump of FIG. 1 at a level of a stator disc of a Siegbahn stage.

The design example according to drawing FIG. 1 is equipped with 3 pump sections in all. The pump section on the high vacuum side consists of turbomolecular pump stages. The stator rings 5 each carry inside facing stator blades 14, to which rotor blades 15 are related these being fixed to the rotor 8. The second pump section has Siegbahn pump stages. These consist of annular rotating discs 16 having flat surfaces which are attached to rotor 8. Between annular rotor discs 16 there are located the annular stator discs 17. The stator rings 6 carry the annular stator discs 17; these are preferably made of one piece. Stator discs 17 are equipped on their face side with spiral projections 18 and corresponding grooves 19 (c.f. drawing FIG. 2). The spiral design is such that a continual gas flow from inlet 12 to outlet 13 is ensured, i.e. so that in the case of the design example which is presented, the active pumping surfaces of the Siegbahn stages above a stator disc 6, pump the gases from the outside to the inside and so that the active pumping surfaces of the Siegbahn stages below a stator disc 6 pump the gases from the inside to the outside. Three each spiral grooves or projections are provided which each extend over 360 degrees. The number, depth, width and pitch of the spirals determine the pumping characteristics of the pump section consisting of Siegbahn stages. By replacing annular stator discs 17 with suitably designed spirals it is possible to adapt the pumping characteristics to differing operating conditions.

Figure 3:
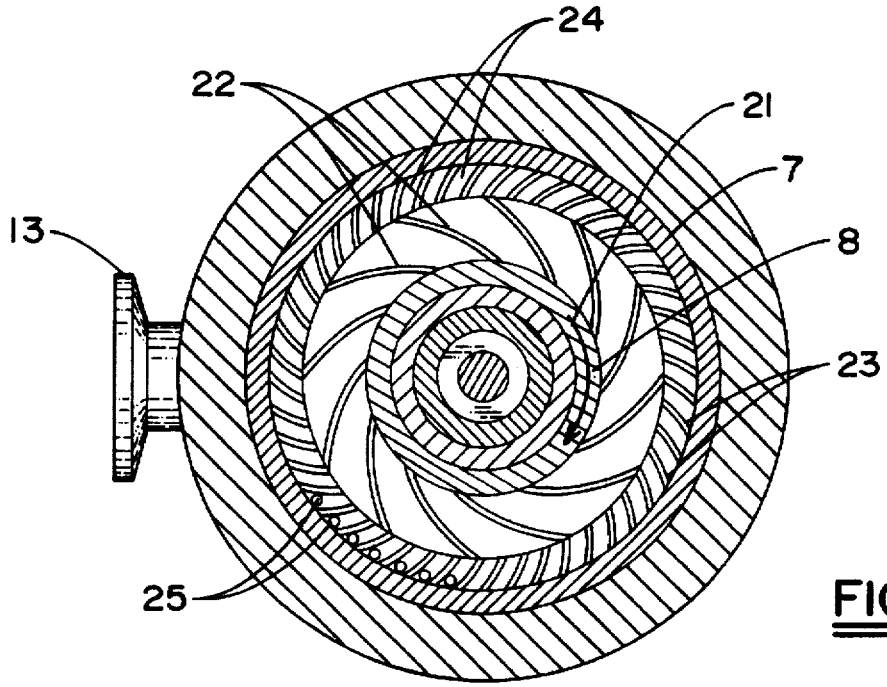
FIG. 3 shows a sectional view along line III—III through the pump of FIG. 1 at a level of a pump stage downstream of the Siegbahn stage.

In the design example according to drawing FIG. 1 the last Siegbahn stage on the pressure side pumps the gases from the outside to the inside. From there they enter a pump stage specially designed for the intermediate range between molecular and viscous flow, the operation of which is designed according to the principle of a gyroscopic machine. This pump stage consists of rotating blades 22 which are attached to the rotor 8 and which with reference to the direction of rotation (arrow 21 in drawing FIG. 3) are bent backwards and which substantially extend in the axial direction. Related to these are guide blades 23 of the gyroscopic machine which are carried by stator ring 7. The guide blades 23 form ducts 24 which are arranged approximately perpendicular to the outer areas of the rotating blades and through which the gas flows approximately in the radial direction towards the outside. At the outer areas, the ducts 24 are equipped with openings 25 though which the gases pass to the forevacuum side of the pump. The path along which the gases flow is marked by arrow 26 in drawing FIG. 1.

In the design example shown in drawing FIG. 1, the first Siegbahn stage after the turbomolecular stage pumps the gases from the outside to the inside. The annular rotor disc 16 ahead of annular stator disc 17 of the first Siegbahn stage has a smaller diameter compared to the other annular rotor discs 16 and carries along its circumference shortened blades 27 compared to the other rotor blades 15. This ensures a transition between the different pumping stages which is as free of disturbances as possible. For the case that the first Siegbahn stage is to pump the gases from the inside to the outside, a correspondingly designed first annular stator disc 17 having a greater inside diameter compared to the other discs may be provided which carries on its inside shortened stator blades.

Figure 4:
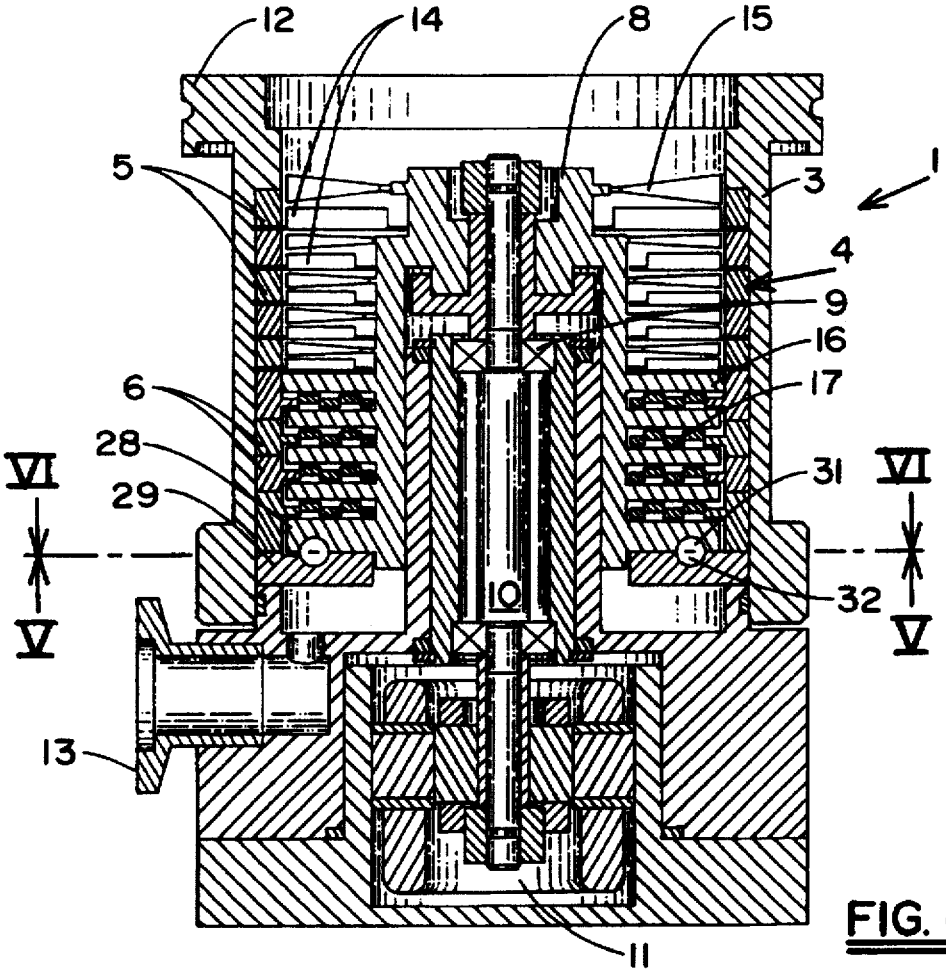
FIG. 4 shows a sectional view of a pump according to an embodiment of the present invention.
Figure 5:
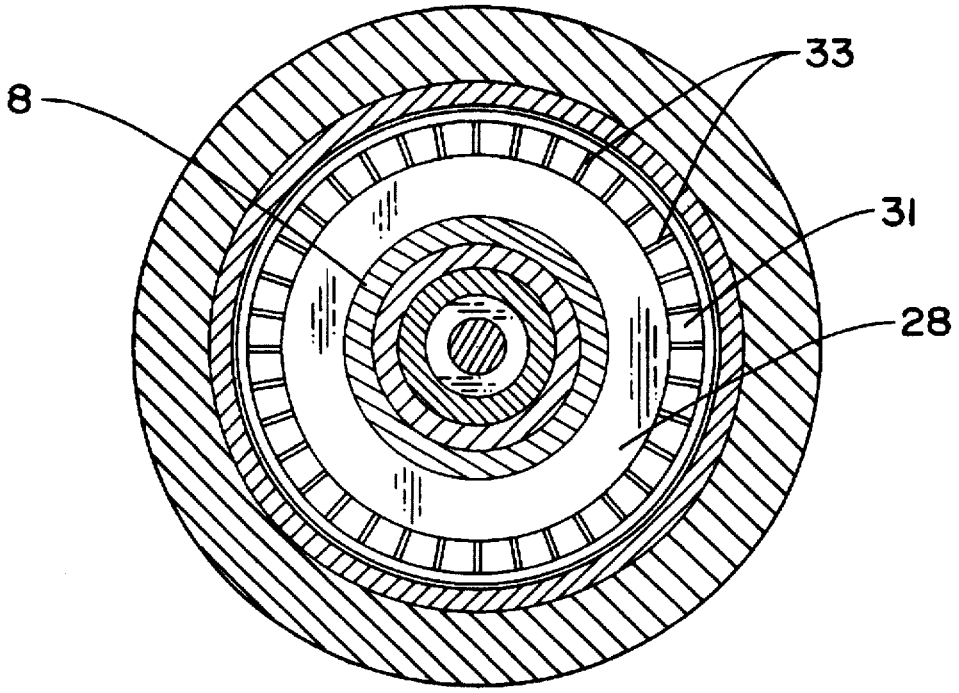
FIG. 5 shows a sectional view along line V—V through the pump of FIG. 4.
Figure 6:
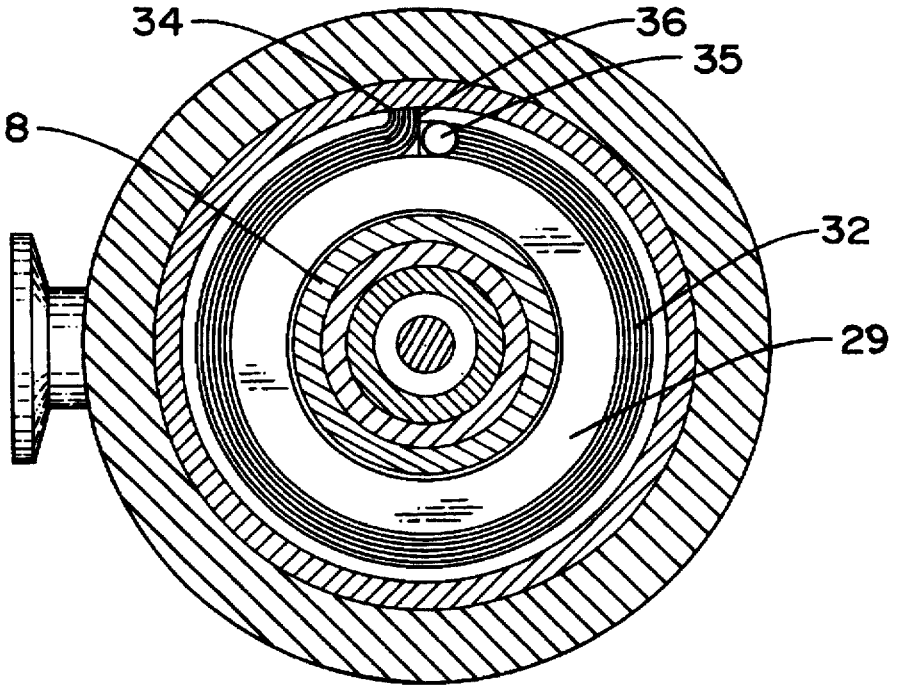
FIG. 6 shows a sectional view along line VI—VI through the pump of FIG. 4.

Also in the case of the design example according to drawing FIG. 4, a turbomolecular pump section followed by a Siegbahn pump section are provided on the high vacuum or the inlet side. The pump section which then follows downstream of the Siegbahn stages on the forevacuum side is designed according to the principle of a side channel pump. For this, substantially circular grooves 31, 32 which face each other and the cross section of which is of a semicircular design are provided in the radially extending surfaces of the last annular rotor disc 28 (drawing FIG. 5) and the last annular stator disc 29 (drawing FIG. 6) facing each other. The rotating groove 31 arranged on the suction side is equipped with numerous transversal ridges 33. The fixed groove 32 arranged on the pressure side has an inlet 34 and an outlet 35 with respect to the pumped gases. Its inlet 34 is a section of a groove extending radially to the outside which accepts the gases flowing through the peripheral pump slot between annular disc 29 and stator 4. The outlet 35 is a borehole which extends substantially in the axial direction and which connects the groove 32 with the forevacuum space. Inlet 34 and outlet 35 are placed directly next to each other and are separated from each other by a ridge (36) in order to prevent backstreaming. A division of groove 32 into two or more groove sections, each with an inlet 34 and an outlet 35 is possible.

Figure 7:
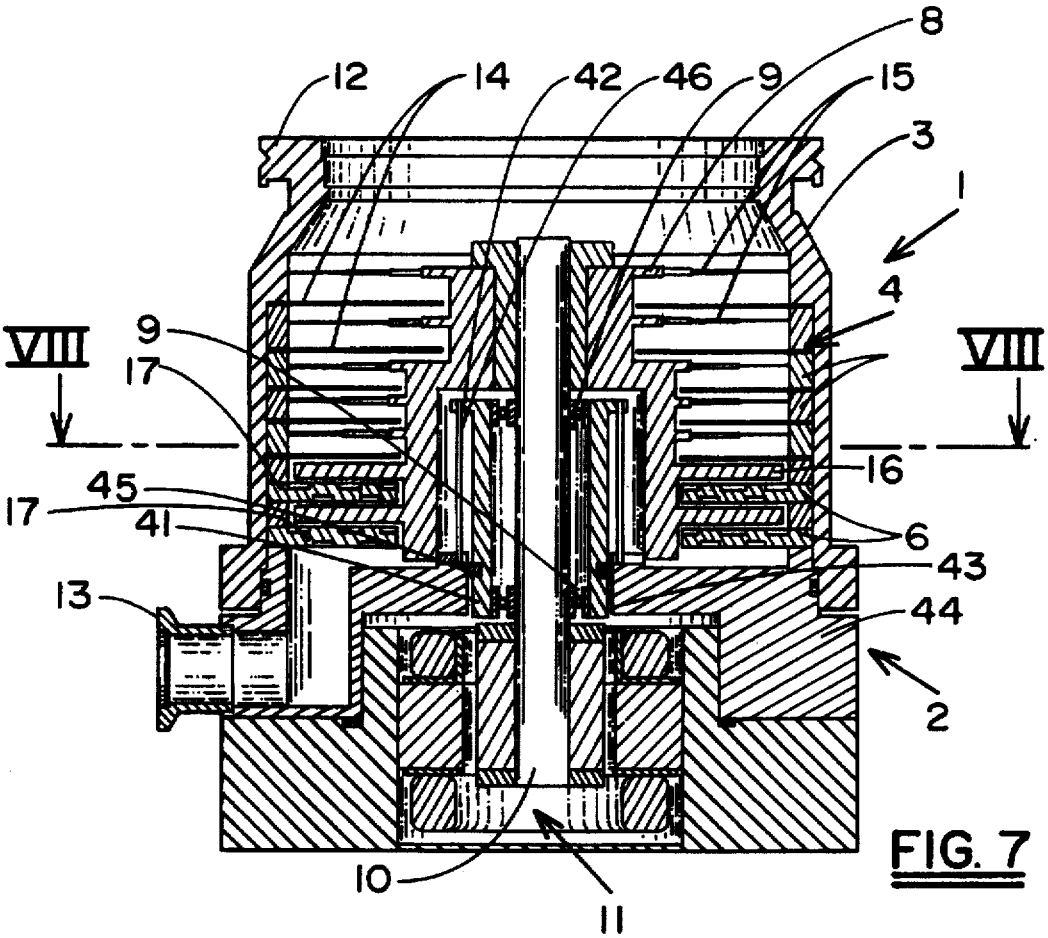
FIG. 7 shows a sectional view of a pump according to an embodiment of the present invention with a special suspension for a rotor.
Figure 8:
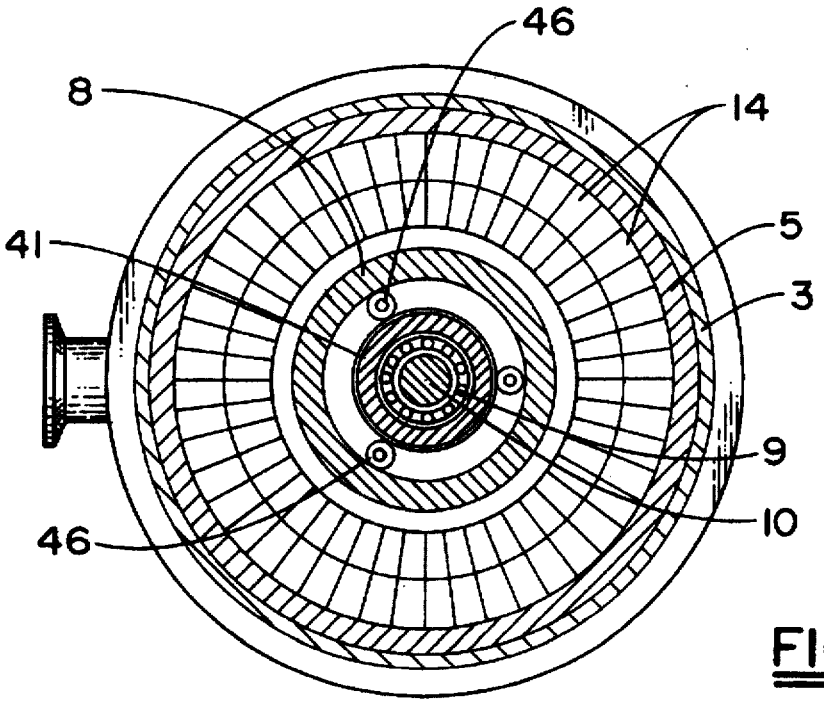
FIG. 8 shows a sectional view along line VIII—VIII through the pump of FIG. 7.

In the design example according to drawing FIGS. 7 and 8, the shaft 10 is supported via its bearings 9 at first on the inside of a sleeve-like support 41. The upper end of the support 41 is equipped with a collar 42. The lower end of the support extends into a recess 43 of a housing component 44 the diameter of which is only slightly greater than the outside diameter of support 41. An O-ring 45 between the support 41 and the inside of recess 43 ensures the central positioning of support 41. In order to support the support 41 in housing 2, three rods 46 which extend substantially in the axial direction are provided which are attached at collar 42 and housing component 44. If a rotor 8 suspended in this manner oscillates due to impacts or when passing through resonances, then the amplitudes are very small and exclusively directed radially. The O-ring 45 acts as an attenuator in the case of oscillations of this kind. Thus the pump slots between the active pumping surfaces, in particular between the annular stator and rotor discs of the Siegbahn stages can be kept very small so that thus a very good pumping effect is attained.

Figure 9:
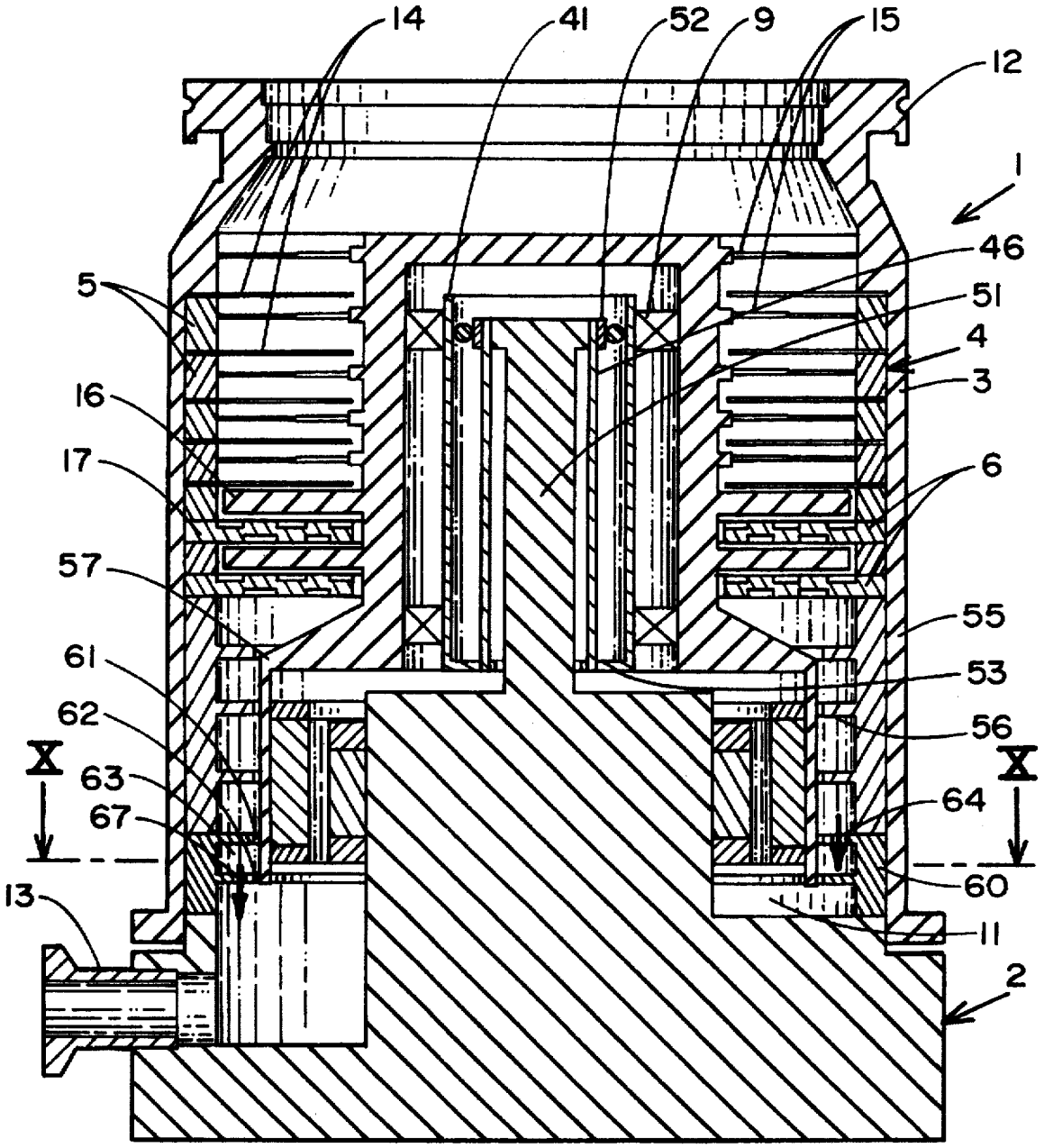
FIG. 9 shows a sectional view of a pump according to an embodiment of the present invention.

Drawing FIG. 9 shows a design example for a pump according to the present invention where the rotor is supported on a fixed journal 51 of housing 2 and drive motor 11 is designed as an external rotor motor. For attachment of the rods 46, the upper end of the journal 51 is equipped with a collar 52. The sleeve-like support 41 has at its lower end an inside facing rim 53. Rods 46 extend between collar 52 and rim 53.

Moreover, the Siegbahn pump section is followed on the pressure side by a Holweck pump section which consists of the stator ring 55 with helical projections 56 and the outside of cylindrical rotor section 57. This carries on its inside the rotor of the motor.

Figure 10:
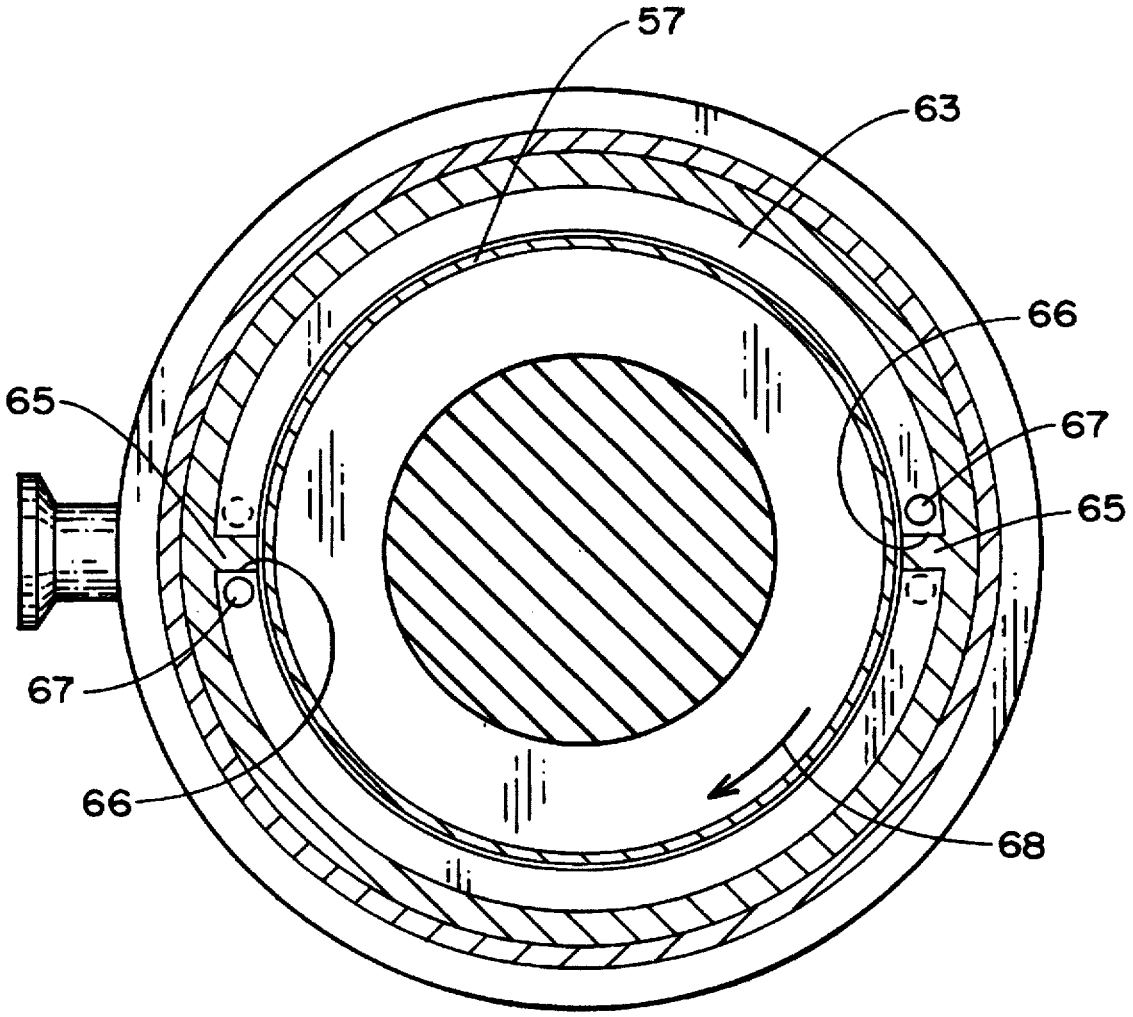
FIG. 10 shows a sectional view along line X—X through the pump of FIG. 9.

Finally, the Holweck pump section is followed by a Gaede pump section. This section comprises on the side of the stator, stator ring 60 with two circular ridges 61, 62 which form the groove 63, and on the side of the rotor the correspondingly extended rotor section 57. One or several openings 64 (c.f. also drawing FIG. 10) in the upper ridge 61 form the inlet into the Gaede pump stages. These are located immediately next to one or several fixed projections 65 which project into groove 63 and which form the barrier slot 66 together which rotor 57. The outlet opening(s) 67 is/are located in the lower ridge 62 and lead into the forevacuum space of pump 1. In the design example according to drawing FIG. 10, the groove 63 is divided into two sections. Two Gaede pump stages arranged in parallel to each other are provided. They each have the inlet opening 64 as well as outlet openings 67 and each extend over approximately 180 degrees. The arrow 68 indicates the direction of rotation of rotor 57.

Figure 11:
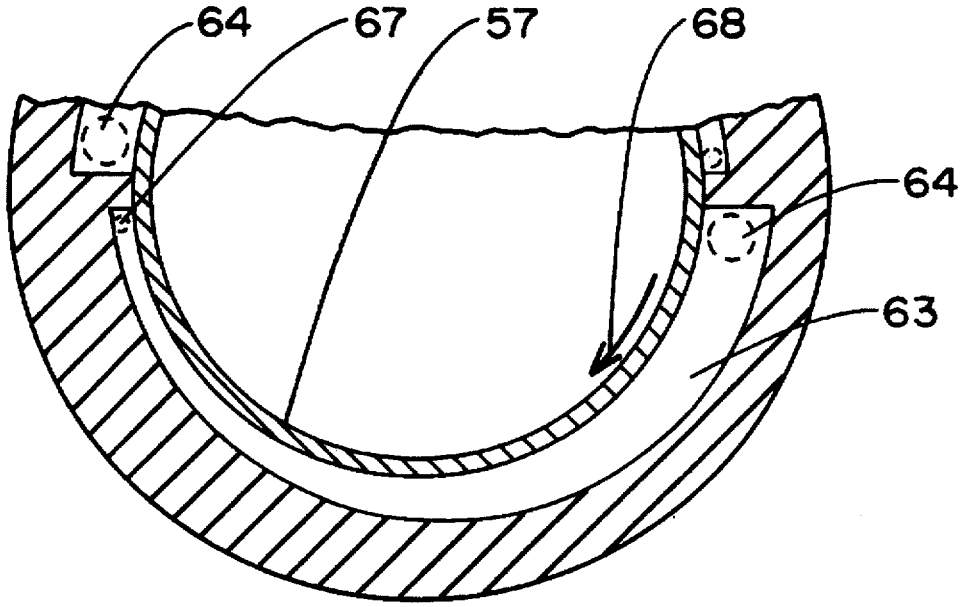
FIG. 11 shows a cross section of part of a Gaede stage with a groove having a decreasing cross-section according to an embodiment of the present invention.
Figure 12:
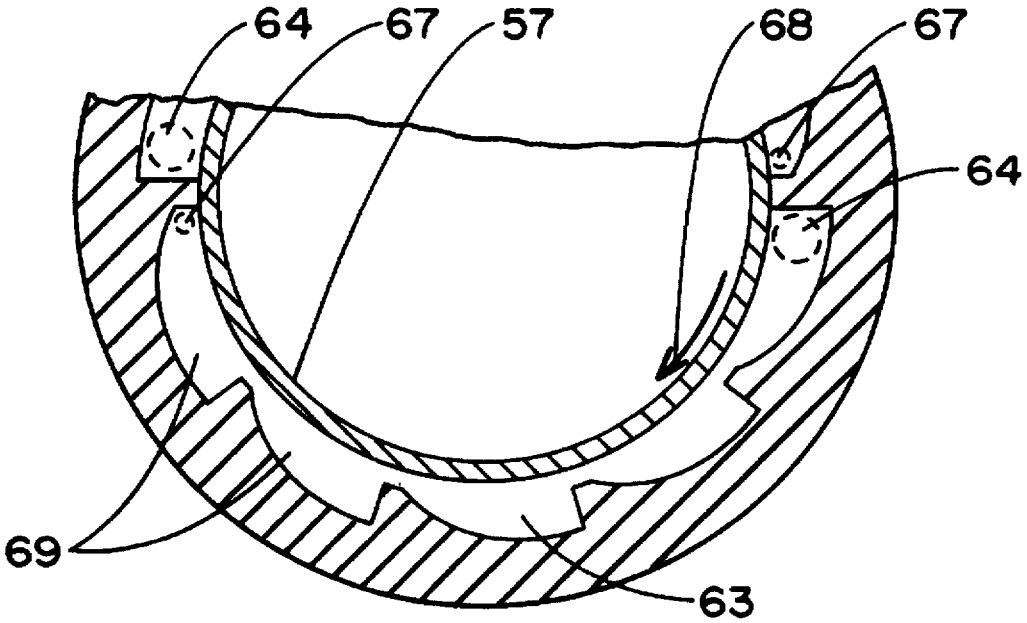
FIG. 12 shows a cross section of part of a Gaede stage with a groove having a continuously changing cross-section according to an embodiment of the present invention.

In the designs according to drawing FIGS. 11 and 12 the design of the groove 63 is no longer circular. By way of suitable selection of groove depth (or also groove width) the sections of groove 63 which extend between inlet 64 and outlet 67 have a decreasing (drawing FIG. 11) or a continuously changing (drawing FIG. 12) cross section. Thus the desired pressure build-up is attained. In the design according to drawing FIG. 12 several chambers 69 are present in which a relatively slow pressure build-up and a relatively fast expansion occurs one after the other. The pressure increases from chamber to chamber.

The drawing FIGS. 13 to 18 show designs for Siegbahn stages which are combined with Gaede stages. The outside diameters of rotating annular discs 17 have been selected in such a way that an outer circular space 71, 72 each is present between their periphery and the stator 4 which surrounds them. Moreover, the inside diameter of the annular stator discs 16 is has been selected in such a manner, that an inner circular space 73, 74 is present for each. From drawing FIGS. 13 and 14 which shows a top view onto an annular stator disc with spiral grooves 19, it is apparent that fixed projections 75, 76 and 77, 78 are located in the circular spaces 71, 72, where said projections form the barrier slots 79, 80 together with the circumference of annular rotor discs 17 or the rotating central section (rotor 8 or shaft 10, for example).

Figure 13:
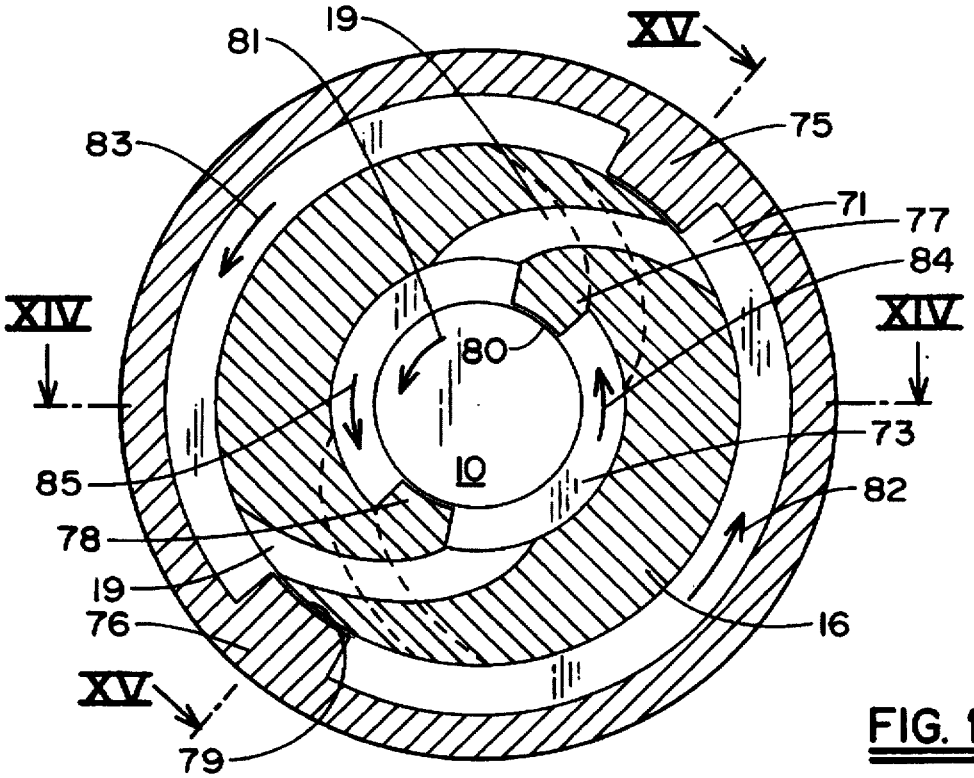
FIG. 13 shows a cross section of two pump stages designed as combined Siegbahn/Gaede stages according to an embodiment of the present invention.
Figure 14:
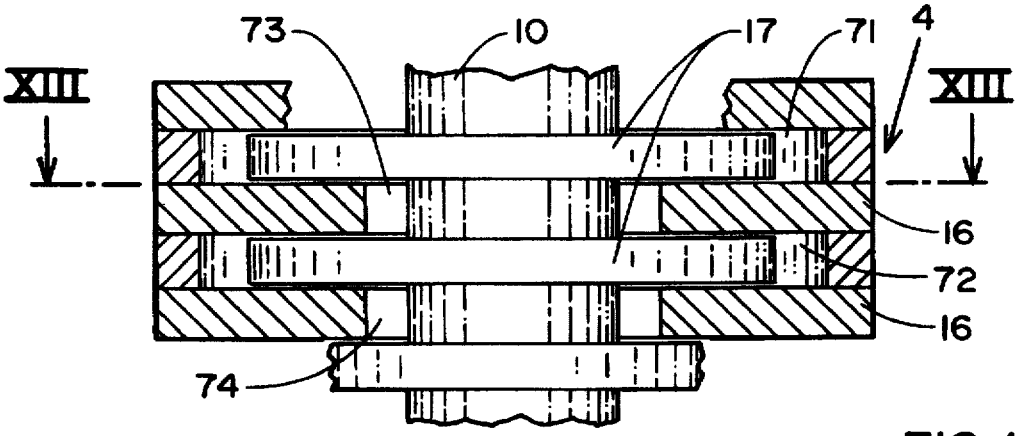
FIG. 14 shows a sectional view along line XIV—XIV through the cross section of FIG. 13.
Figure 15:
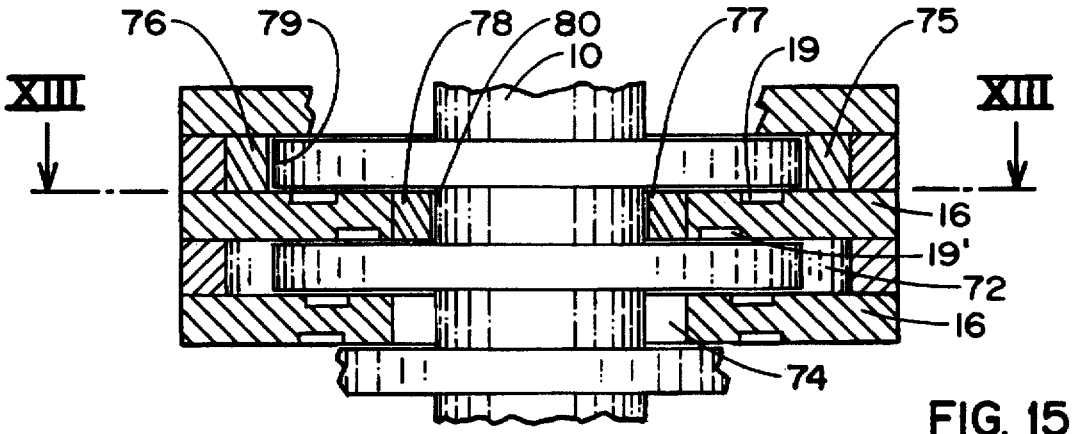
FIG. 15 shows a sectional view along line XV—XV through the cross section of FIG. 13.

During operation the rotor turns in the direction of arrow 81 (drawing FIG. 13). This rotation pulls the gas molecules along in the two sections of circular space 71 in the direction of the arrows 82, 83 (Gaede pumping effect).

Owing to the presence of the projections 75, 76 the gases are pumped to the inside into the spiral grooves (Siegbahn pumping effect) and there they enter into the sections of the circular space 73. There they are pulled along in the direction of arrows 84, 85 and arrive on the bottom side of the stator disc 16 the top view of which is shown in drawing FIG. 13, thereby entering grooves 19 which are designed in such a manner that they pump the gases to the outside again.

Figure 16:
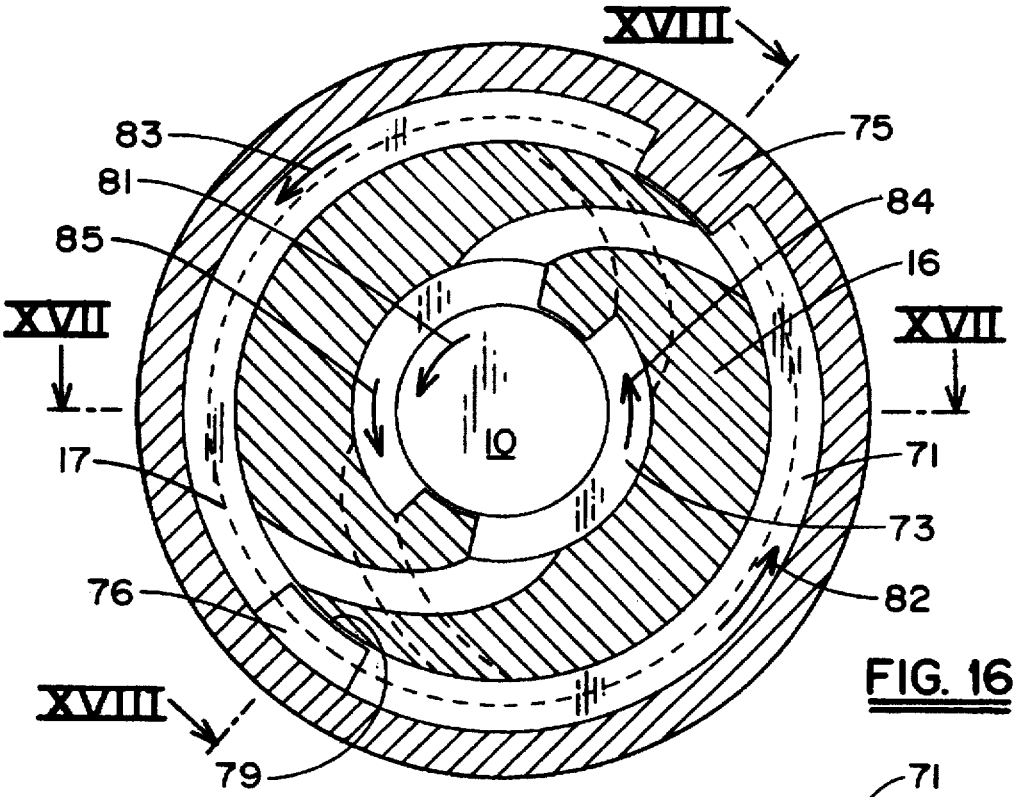
FIG. 16 shows a cross section of two pump stages designed as combined Siegbahn/Gaede stages according to an embodiment of the present invention.
Figure 17:
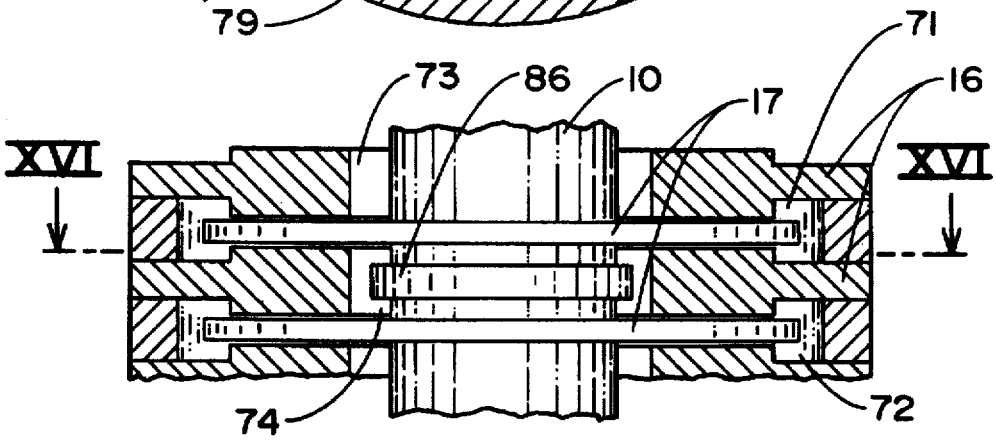
FIG. 17 shows a sectional view along line XVII—XVII through the cross section of FIG. 16.
Figure 18:
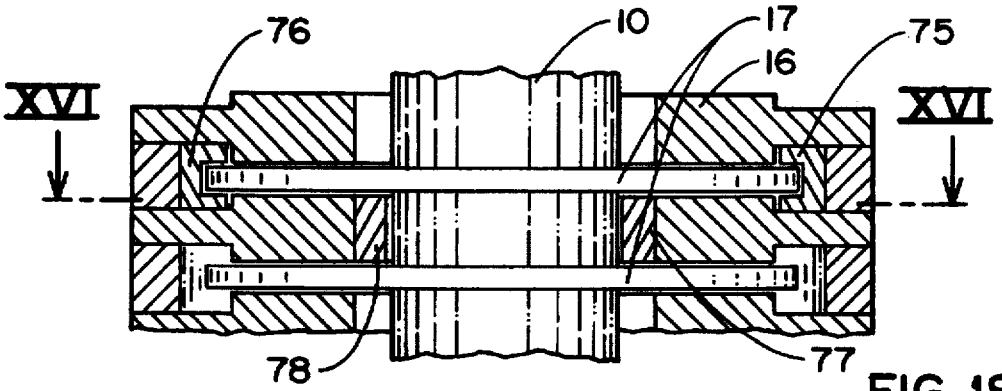
FIG. 18 shows a sectional view along line XVIII—XVIII through the cross section of FIG. 16.
Figure 19:
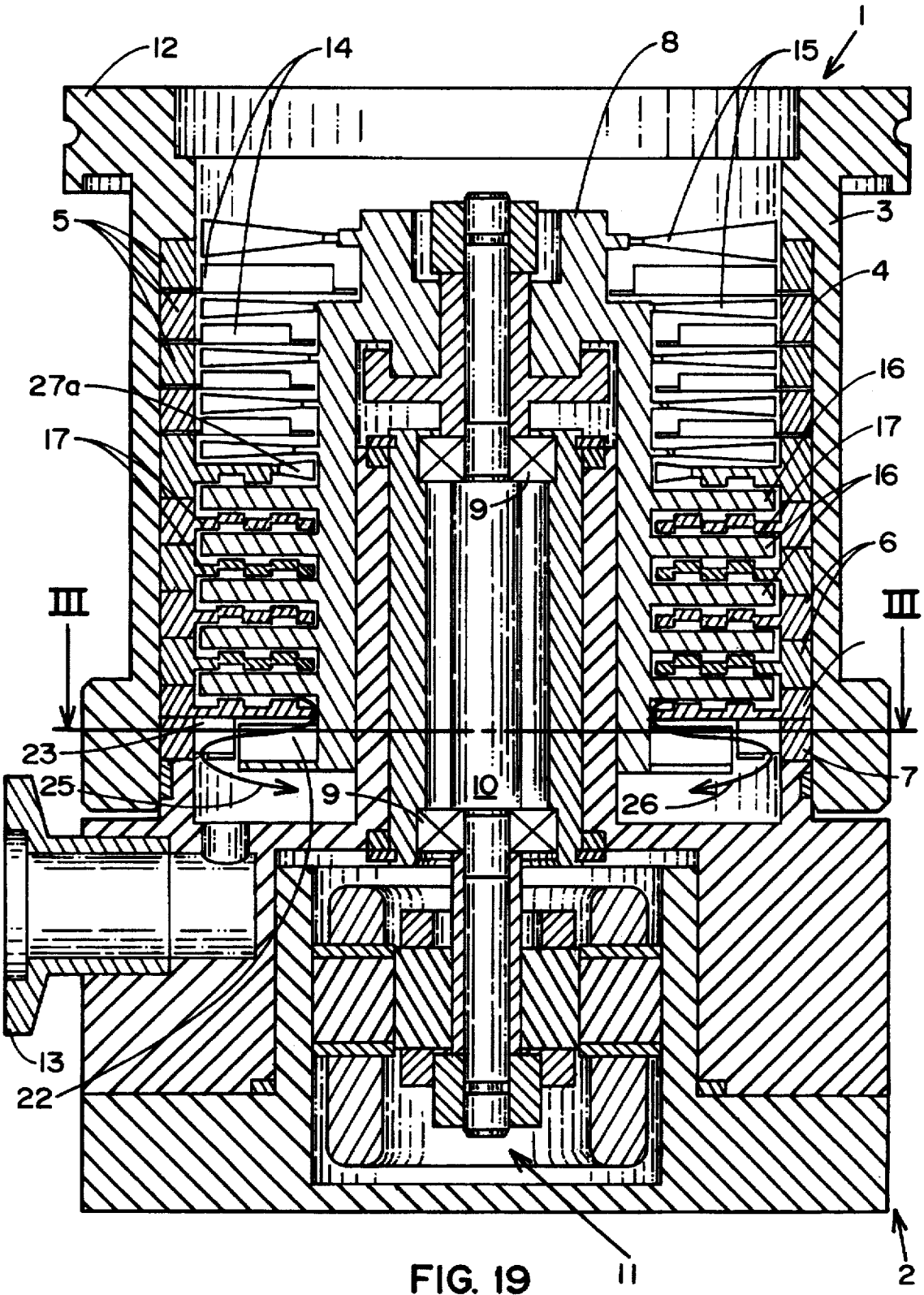
FIG. 19 shows a sectional view of a friction vacuum pump according to an embodiment of the present invention.

In the design example according to drawing FIGS. 16 to 18, the active pumping surfaces have been enlarged by having selected the height of the outer circular spaces 71, 72 greater than the thickness of the rotating discs 17 and so that the outside edges of discs 17 extend into the circular spaces 71, 72. In this solution the projections 75, 76 must be U-shaped (drawing FIG. 18). The active pumping surface inside the inner circular spaces may also be enlarged when equipping the rotating central section with projections. An example for a ring-shaped projection 86 is indicated in drawing FIG. 17.

The solutions for combined Gaede/Siegbahn stages which are described and shown in drawing FIGS. 13 to 18 may be present instead of the Siegbahn stages effective in the pumps according to drawing FIGS. 1, 4 and 7. However, the combined stages are especially suitable for pump sections close to the forevacuum side. Any number of barrier slots may be employed in each of the circular spaces 71 to 74. They must be adapted to the number and shape of the grooves 19 located on the annular stator discs.

We claim:

1. A friction vacuum pump with pump sections of different designs, comprising:

a first pump section on an inlet side comprising turbomolecular pump stages;

a second pump section of Siegbahn stages comprising annular rotor discs and annular stator discs comprising spiral grooves, such that each active pumping surface of the Siegbahn stages is formed by facing surfaces of one of said annular rotor discs and a respective one of said annular stator discs; and a first annular disc of the Siegbahn stages following the turbomolecular pump stages which carries one of stator blades and rotor blades, and which has a width smaller than widths of remaining annular stator discs and annular rotor discs of said Siegbahn stages.

2. A pump according to claim 1, wherein said second pump section of Siegbahn stages is followed by at least one third section including means for allowing an intermediate flow range between molecular flow and viscous flow.

3. A pump according to claim 2, wherein at least one stage of said at least one third section is designed according to principles of one of a gyroscopic type machine, a side channel type pump, a Holweck type pump, and a Gaede type pump.

4. A pump according to claim 4 wherein said means for allowing an intermediate flow range comprises rotating blades on a side of a rotor and guide blades on a side of a stator, whereby the guide blades form ducts equipped with openings situated toward a forevacuum side of the pump.

5. A pump according to claim 3 wherein said at least one third section is the side channel pump and includes first and second facing grooves provided in a second annular rotor disc and a second annular stator disc, respectively.

6. A pump according to claim 5, wherein said first and second facing grooves are substantially circular.

7. A pump according to claim 5 wherein said second facing groove includes two concentrically arranged pairs of grooves.

8. A pump according to claim 1, wherein at least one of said Siegbahn stages is combined with a Gaede stage.

9. A friction vacuum pump with pump sections of different designs, comprising:

a first pump section on an inlet side comprising turbomolecular pump stages;

a second pump section of Siegbahn stages comprising annular rotor discs and annular stator discs comprising spiral grooves, such that each active pumping surface of the Siegbahn stages is formed by facing surfaces of one of said annular rotor discs and a respective one of said annular stator discs;

wherein said second pump section of Siegbahn stages is followed by at least one third pump section including means for allowing an intermediate flow range between molecular flow and viscous flow;

at least one stage of said third pump section is designed according to principles of a Gaede type pump;

and said at least one stage of said third pump section including two radially extending ridges arranged in parallel, a cylindrical rotor section, a ridge groove formed by the radially extending ridges that is equipped with at least one opening, and at least one projection for the formation of at least one barrier slot.

10. A pump according to claim 9, wherein said ridge groove is equipped with a plurality of openings comprising a first inlet opening and a first outlet opening, and one of either said ridge groove or a section of said ridge groove, but not both, extends from the first inlet opening to the first outlet opening and has a steadily reducing cross section.

11. A pump according to claim 9, wherein said ridge groove is equipped with a plurality of openings comprising a first inlet opening and a first outlet opening, and one of either said ridge groove or a section of said ridge groove, but not both, extends from the first inlet opening to the first outlet opening and has a continuously changing cross section.

12. A pump according to claim 11, wherein said continuously changing cross section is comprised by means for allowing a relatively slow pressure build-up and a relatively fast expansion to take place several times one after the other.

13. A friction vacuum pump with pump sections of different designs, comprising:

a first pump section on an inlet side comprising turbomolecular pump stages; and a second pump section of Siegbahn stages comprising annular rotor discs and annular stator discs comprising spiral grooves, such that each active pumping surface of the Siegbahn stages is formed by facing surfaces of respective ones of the annular rotor discs and respective ones of the annular stator discs comprising the spiral grooves, wherein at least one of the Siegbahn stages is combined with a Gaede stage, and wherein at least one of the annular stator discs forms together with a rotor an inner circular space.

14. A pump according to claim 13, wherein said rotor at said inner circular space is equipped with means for increasing one active pumping surface.

15. A friction vacuum pump with pump sections of different designs, comprising:

a first pump section on an inlet side comprising turbomolecular pump stages; and a second pump section of Siegbahn stages comprising annular rotor discs and annular stator discs comprising spiral grooves, such that each active pumping surface of the Siegbahn stages is formed by facing surfaces of one of the annular rotor discs and a respective one of the annular stator discs comprising the spiral grooves, wherein at least one of the Siegbahn stages is combined with a Gaede stage thereby forming a combined Gaede/Siegbahn stage, wherein at least one of the annular rotor discs in the combined Gaede/Siegbahn stage forms together with a stator an outer circular space, and wherein a height of the outer circular space is greater than a thickness of the at least one of the annular rotor discs, such that an outside edge of the at least one of the annular rotor discs extends into the circular space.

16. A friction vacuum pump with pump sections to of different designs, comprising:

a first pump section on an inlet side comprising turbomolecular pump stages;

a second pump section of Siegbahn stages comprising annular rotor discs and annular stator discs comprising spiral grooves, such that each active pumping surface of the Siegbahn stages is formed by facing surfaces of one of the annular rotor discs and a respective one of the annular stator discs comprising the spiral grooves;

a housing, a plurality of rods extending in a substantially axial direction within the housing;

a sleeve-like support supported by the plurality of rods; and a rotor supported on an inside of the sleeve-like support by means of a bearing.

17. A pump according to claim 16, wherein said sleeve-like support is supported by three of said rods.

18. A friction vacuum pump with pump sections of different designs, comprising:

a first pump section on an inlet side comprising turbomolecular pump stages;

a second pump section of Siegbahn stages comprising annular rotor discs and annular stator discs comprising spiral grooves, such that each active pumping surface of the Siegbahn stages is formed by facing surfaces of one of the annular rotor discs and a respective one of the annular stator discs, wherein a first annular disc of the Siegbahn stages is one of the annular rotor discs, the first annular disc having a smaller diameter than others of the annular rotor discs, and the first annular disc carrying on its circumference rotor blades that are shorter than rotor blades of the turbomolecular pump stages.

19. A pump according to claim 18, wherein said second pump section of Siegbahn stages is followed by at least a third section including means for allowing an intermediate flow range between molecular flow and viscous flow.

20. A pump according to claim 19, wherein at least one stage of said third pump section is designed according to principles of one of a gyroscopic type machine, a side channel type pump, a Holweck type pump, and a Gaede type pump.

21. A pump according to claim 20, wherein a last pump stage on a forevacuum side of the pump comprises rotating blades on a side of a rotor and guide blades on a side of a stator, whereby the guide blades form ducts equipped with openings situated toward the forevacuum side of the pump.

22. A pump according to claim 19, wherein a last pump stage of said third pump section of the pump is a side channel pump comprising first and second facing grooves provided in a second annular rotor disc and a second annular staler disc, respectively.

23. A pump according to claim 22, where said first and second facing grooves are substantially circular.

24. A pump according to claim 22, wherein said second facing groove in said second annular stator disc includes two concentrically arranged pairs of grooves.

25. A friction vacuum pump with pump sections of different designs, comprising:

a first pump section on an inlet side comprising turbomolecular pump stages;

a second pump section of Siegbahn stages comprising annular rotor discs and annular stator discs comprising spiral grooves, such that each respective active pumping surface of the Siegbahn stages is formed by facing surfaces of one of the annular rotor discs and a respective one of the annular stator discs, wherein a first annular disc of the Siegbahn stages is one of the annular stator discs, the first annular disc having a greater inside diameter than others of the annular stator discs, and the first annular disc carrying on its circumference stator blades that are shorter than stator blades of the turbomolecular pump stages.

26. A pump according to claim 25, wherein said second pump section of Siegbahn stages is followed by at least a third section including means for allowing an intermediate flow range between molecular flow and viscous flow.

27. A pump according to claim 26, wherein at least one stage of said third pump section is designed according to principles of one of a gyroscopic type machine, a side channel type pump, a Holweck type pump, and a Gaede type pump.

28. A pump according to claim 27, wherein a last pump stage on a forevacuum side of the pump comprises rotating blades on a side of a rotor and guide blades on a side of a stator, whereby the guide blades form ducts equipped with openings situated toward the forevacuum side of the pump.

29. A pump according to claim 26, wherein a last pump stage of said third pump section is a side channel pump comprising first and second facing grooves provided in a second annular rotor disc and a second annular stator disc, respectively.

30. A pump according to claim 29, wherein said first and second facing grooves are substantially circular.

31. A pump according to claim 29, wherein said second facing groove in said second annular stator disc includes two concentrically arranged pairs of grooves.

* * * * *

UNITED STATES PATENT AND TRADEMARK OFFICE

CERTIFICATE OF CORRECTION

PATENT NO. : 5,695,316
DATED : December 9, 1997
INVENTOR(S) : Schutz, et al.

It is certified that error appears in the above—identified patent and that said Letters Patent is hereby corrected as shown below:

Column 6, Line 27, Claim 4 in the text please delete "4" and insert --3--.

Signed and Sealed this

Second Day of June, 1998

*Attest:*

*Attesting Officer*

BRUCE LEHMAN

*Commissioner of Patents and Trademarks*